United States Patent [19]

Pineau

[11] Patent Number: 4,670,048

[45] Date of Patent: Jun. 2, 1987

[54] METHOD FOR HEATING THE REDUCING GAS OF A BLAST FURNACE BY MEANS OF A PLASMA GENERATOR

[75] Inventor: Didier Pineau, Bordeaux, France

[73] Assignee: Societe Nationale Industrielle Aerospatiale, Paris, France

[21] Appl. No.: 747,825

[22] Filed: Jun. 24, 1985

[30] Foreign Application Priority Data

Jul. 2, 1984 [FR] France ..... 84 10467

[51] Int. Cl.[4] ..... C22B 9/00; H05H 1/005

[52] U.S. Cl. ..... 75/10.19; 75/10.22; 373/19

[58] Field of Search ..... 75/11, 10 R, 41, 42, 75/10.19, 10.22; 373/19

[56] References Cited

U.S. PATENT DOCUMENTS 4,363,656 12/1982 Ponghis et al. ..... 75/42

4,455,165 6/1984 Santen et al. ..... 75/11

FOREIGN PATENT DOCUMENTS 1068174 5/1967 United Kingdom ..... 373/22

*Primary Examiner*—Melvyn J. Andrews

*Attorney, Agent, or Firm*—Fisher, Christen & Sabol

[57] ABSTRACT

Method for heating the reducing gas of a blast furnace by means of a plasma generator. The reducing gas flows through a pipe into which issues the nozzle of the plasma generator. The pipe leads towards a tuyere of injection into the blast furnace, and the axis of said nozzle converging towards that of the pipe. The method is characterized in that the acute angle A between the axis of the nozzle and the axis of the pipe is at the most equal to 50°, in that the distance 1 separating the point of intersection of the axis of the pipe with the axis of the nozzle from the center of the outlet orifice of the nozzle is at the most equal to D/2sinA, D being the inner diameter of the reducing gas inlet pipe, and in that the ratio D/d, in which d is the inner diameter of the outlet orifice of the nozzle is at least equal to 1.5. The object of the method is to eliminate wear of the reducing gas pipe by means of the jet of plasma.

9 Claims, 2 Drawing Figures

METHOD FOR HEATING THE REDUCING GAS OF A BLAST FURNACE BY MEANS OF A PLASMA GENERATOR

The present invention relates to a method for heating the reducing gas of a blast furnace by means of a plasma generator.

It is known that the temperature of the reducing gas in a blast furnace should advantageously be raised in order to increase production and to reduce the quantity of coke required to operate the blast furnace.

To this effect, it is already known to equip the blast furnace with a plasma generator and to connect the outlet of said generator to the inlet pipe bringing the reducing gas to the tuyere injecting it into said blast furnace.

This technique is described for example, in French Pat. Nos. 2 223 449, 2 223 647 and 2 515 326, in British Pat. No. 1 488 976 and in U.S. Pat. No. 4,363,656.

But it has raised a number of implementing difficulties. Indeed, the plasma formed by the generator reaches a very high temperature (several thousand degrees Celsius), so that, when it penetrates into the reducing gas inlet pipe and when it comes into contact with the wall of said pipe, it speeds up wear, leading to an early destruction of the walls. U.S. Pat. No. 4,363,656 already mentions this disadvantage about the technique described in British Pat. No. 1 488 976, and proposes, as a remedy, to incline the axes of the plasma generator and of the reducing gas inlet pipe with respect to the axis of the tuyere of injection into the blast furnace. This creates a bend between the reducing gas inlet pipe and the tuyere which can disturb the flow of reducing gas. And this type of solution is not readily adaptable in an already existing blast furnace undergoing improvements.

It is the object of the present invention to propose a method for heating the reducing gas of a blast furnace by means of a plasma generator, in which no major modifications are required to be made in the blast furnace to which said method is applied; such method does not basically change the working principle of the blast furnace and it does not question the necessity of the alignment of the tuyere with the adjacent portion of the reducing gas inlet pipe, but it prevents all risks of excessive wear and of destruction of the walls of said pipe by the plasma.

The invention proposes to this end a method for heating the reducing gas of a blast furnace by means of a plasma generator, said reducing gas flowing through a pipe into which the nozzle of said plasma generator issues, said pipe leading to a tuyere of injection into a blast furnace, and the axis of said nozzle converging towards that of said inlet pipe. The method is remarkable in that the acute angle A between the axis of the nozzle and the axis of the pipe is at the most equal to 50°, in that the distance l separating the point of intersection of the axis of the inlet pipe with the axis of the nozzle from the center of the outlet orifice of said nozzle is at the most equal to D/2 sin A, D being the inner diameter of the reducing gas inlet pipe, and in that the ratio D/d, in which d is the inner diameter of said outlet orifice of the nozzle, is at least equal to 1.5.

The Applicant has indeed found that, if the conditions set out above were met, a shielding of reducing gas was created around the plasma jet, thus isolating the walls of the inlet pipe from contact with said plasma jet and as a result protecting them against the destroying action thereof. It is found that, in the aforesaid conditions, the penetration of the plasma jet creates a turbulence ensuring the sweeping of the inner wall of the inlet pipe by the reducing gas, thus creating a kind of jacket.

Preferably, the angle A between the axis of the nozzle of the plasma generator and the axis of the reducing gas inlet pipe is around 40°.

If the ratio D/d, although remaining above 1.5, is less than 4, it is advantageous for the distance l to be at least equal to D/6 sin A. If the ratio D/d is greater than 4, the distance l may have a tendency to go towards zero.

The invention will be more readily understood on reading the following description with reference to the accompanying drawings, in which.

Figure 1:
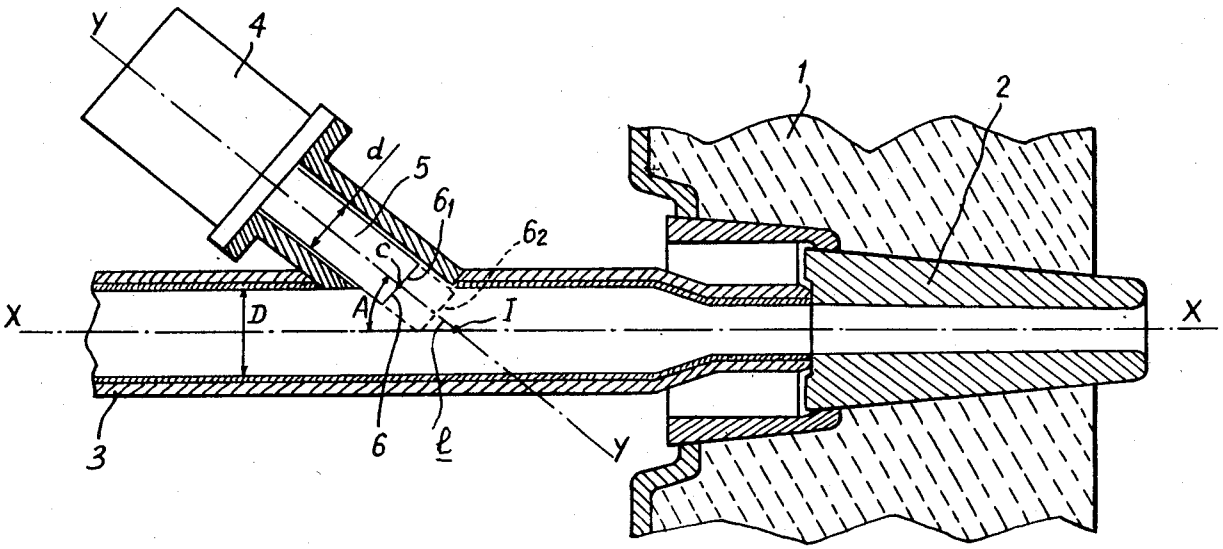
FIG. 1 is a diagrammatical and partial cross-section, illustrating the method according to the invention.

FIG. 1 shows a portion of the wall 1 of a blast furnace, in which is fitted a tuyere 2 for the injection of the reducing gas. Said tuyere 2 is supplied with reducing gas via a pipe 3. The tuyere 2 and pipe 3 are in alignment and have the same axis X—X.

The reducing gas flowing through pipe 3 has for example a temperature of 1300° C., with a pressure of 1.5 relative bar and its flow rate is for example 500N m3/hr. A plasma generator 4 is by-pass fitted on the pipe 3, the nozzle 5 of which generator sends a jet of plasma through its outlet orifice 6. The nozzle 5 penetrates into the pipe 3 and its axis Y—Y forms an acute angle A equal to 40° with respect to the axis X—X of the pipe 3. Axes X—X and Y—Y intersect in I and the distance l between the point I and the center C of the outlet orifice 6 of the nozzle is at the most equal to $l=D/2 \sin A$ (position $6_1$) and at least equal to $l=D/6 \sin A$ (position $6_2$), if the ratio D/d of the inner diameters of the pipe 3 and of the nozzle 5 is more than 1.5 but less than 4. If said ratio D/d were above 4, the point C would be mistaken with point I.

The temperature of the plasma jet is for example 4300° C., with a pressure of 2.5 relative bars and its flowrate is for example 4500 Nm3/hr.

If the aforesaid conditions are met, it is found that the plasma jet produced by the generator 4 is shielded by the reducing gas and the inner walls of the pipe 3 are isolated from said plasma.

Figure 2:
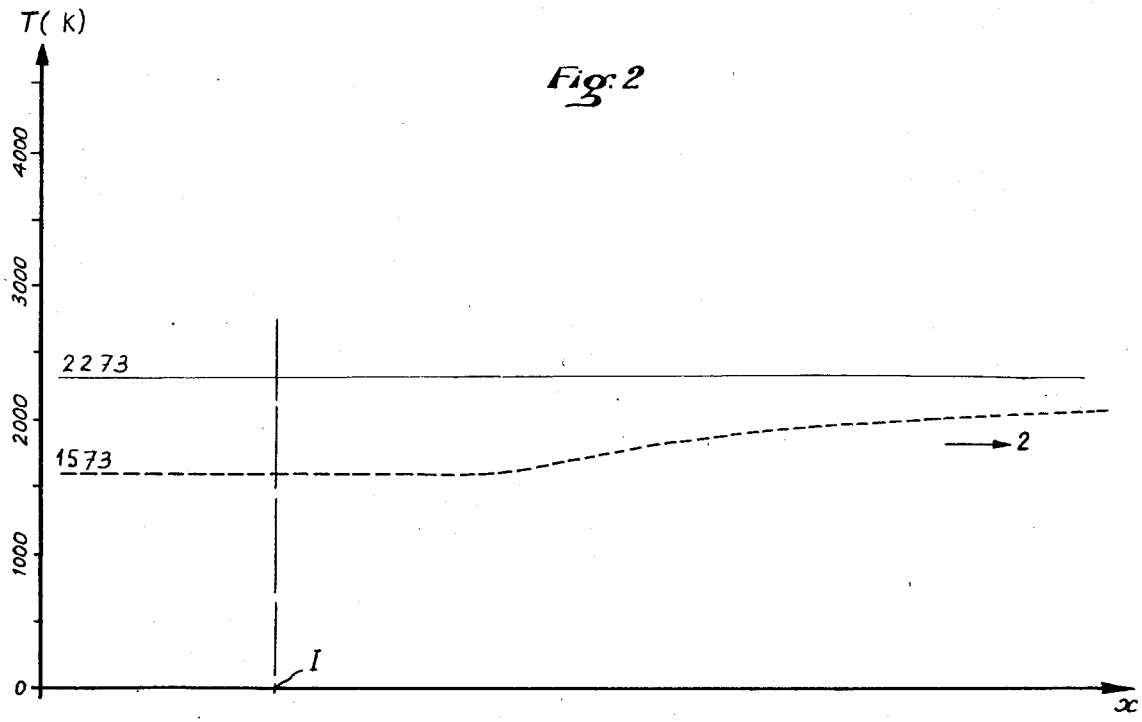
FIG. 2 is a chart giving the variations of the temperature T (in K.) of the wall of the reducing gas inlet pipe as a function of an x-axis measured in parallel to the axis of said pipe.

This result is illustrated in FIG. 2 which shows, on the one hand, that the temperature of the wall 3 which is of 1573° K. (namely 1300° C.) upstream of the point I, does not immediately increase downstream thereof, and on the other hand, that the temperature increase downstream of point I is moderate and progressive, evolving regularly, without any hot points appearing, towards the temperature of the mixture which is around 2000° C. (2273° K.).

I claim:

1. Method for heating the reducing gas of a blast furnace by means of a plasma generator having a nozzle with an outlet orifice, comprising:

injecting said reducing gas through an inlet pipe having a wall with an inner lining and a terminal tuyere of injection into said blast furnace, the axis of said terminal tuyere and the axis of at least a portion of said inlet pipe near said terminal tuyere being aligned;

injecting the plasma jet generated by said plasma generator into said inlet pipe through said outlet orifice of said nozzle in the vicinity of said terminal tuyere so as to keep said plasma jet away from the wall of said inlet pipe thereby causing minimal or no damage to the inner lining of the inlet pipe; and the axis of said nozzle converging towards a point of intersection with said axis of said portion of said inlet pipe, and forming an acute angle A between the axis of the nozzle and the axis of said portion of said pipe being greater than zero and at most equal to 50°, the distance l separating said point of intersection from the center of said outlet orifice of the nozzle being at the most equal to $$D/2 \sin A$$

D being the inner diameter of the reducing gas inlet pipe, and the ratio $$D/d,$$

in which d is the inner diameter of said outlet orifice of the nozzle, being at least equal to 1.5.

2. Method as claimed in claim 1 wherein the angle between the axis of the nozzle of the plasma generator and the axis of the reducing gas inlet pipe is approximately 40°.

3. Method as claimed in claim 1 wherein the ratio $$d/d$$

is less than 4 and wherein the distance l is at least equal to $$D/6 \sin A.$$

4. Method as claimed in claim 1 wherein the distance l is zero or close to zero.

5. The method as claimed in claim 1 wherein the plasma jet is injected from a distance of at least $$D/6 \sin A$$

to a point on the axis of rotation of the inlet pipe.

6. The method of injecting said plasma jet according to claim 1, further comprising injecting said plasma jet at a temperature of approximately 4,300° C. into said inlet pipe wherein said reducing gas has a temperature of approximately 1,300° C., and creating a turbulent flow of said reducing gas downstream of said nozzle for the sweeping of said inner lining of said inlet pipe by the reducing gas such that the temperature of said inner lining increases gradually downstream of said nozzle.

7. Apparatus for injecting hot gases into a blast furnace, comprising:

(a) a terminal tuyere for injecting hot gases into a blast furnace;

(b) an inlet pipe aligned and communicating with said tuyere for supplying gas to said tuyere, said inlet pipe having inner walls with an internal diameter D, said inlet pipe having a gas inlet at a rearward end and a gas outlet connected to said tuyere at a forward end;

(c) a plasma generator having an outlet nozzle on a forward end, said outlet nozzle having an outlet orifice with an internal diameter d, said outlet orifice communicating with said inlet pipe, said outlet nozzle being connected to said inlet pipe, wherein the plasma generator has rearward portions extending rearward of the connection of the outlet nozzle and the inlet pipe such that an angle formed by the axis of said nozzle and the axis of said inlet pipe is greater than 0° and at most equal to 50° and the distance l between the center of said outlet orifice of said nozzle and the point of intersection of said axes of said inlet pipe and said nozzle is from zero to $$D/2 \sin A$$

and the ratio $$D/d$$

is at least equal to 1.5.

8. The apparatus as claimed in claim 7 wherein the angle between the axis of the nozzle and the axis of the inlet pipe is between 35° and 45°.

9. The apparatus as claimed in claim 7 wherein the ratio $$D/d$$

is less than 4, and the distance l is at least equal to $$D/6 \sin A.$$

* * * * *